US006326869B1

(12) United States Patent
Felden et al.

(10) Patent No.: US 6,326,869 B1
(45) Date of Patent: Dec. 4, 2001

(54) CLAPPER ARMATURE SYSTEM FOR A CIRCUIT BREAKER

(75) Inventors: Walter Felden; Matthias Reichard, both of Neumunster (DE)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/401,236

(22) Filed: Sep. 23, 1999

(51) Int. Cl.[7] ..... H01H 81/00
(52) U.S. Cl. ..... 335/35; 335/172
(58) Field of Search ..... 338/35, 22, 23, 338/25, 167–176, 36–45; 337/75–77

(56) References Cited

U.S. PATENT DOCUMENTS

| | | |
|---|---|---|
| D. 367,265 | 2/1996 | Yamagata et al. . |
| 2,340,682 | 2/1944 | Powell . |
| 2,719,203 | 9/1955 | Gelzheiser et al. . |
| 2,937,254 | 5/1960 | Ericson . |
| 3,158,717 | 11/1964 | Jencks et al. . |
| 3,162,739 | 12/1964 | Klein et al. . |
| 3,197,582 | 7/1965 | Norden . |
| 3,307,002 | 2/1967 | Cooper . |
| 3,517,356 | 6/1970 | Hanafusa . |
| 3,631,369 | 12/1971 | Menocal . |
| 3,803,455 | 4/1974 | Willard . |
| 3,883,781 | 5/1975 | Cotton . |
| 4,129,762 | 12/1978 | Bruchet . |
| 4,144,513 | 3/1979 | Shafer et al. . |
| 4,158,119 | 6/1979 | Krakik . |
| 4,165,453 | 8/1979 | Hennemann . |
| 4,166,988 | 9/1979 | Ciarcia et al. . |
| 4,220,934 | 9/1980 | Wafer et al. . |
| 4,255,732 | 3/1981 | Wafer et al. . |
| 4,259,651 | 3/1981 | Yamat . |
| 4,263,492 | 4/1981 | Maier et al. . |
| 4,276,527 | 6/1981 | Gerbert-Gaillard et al. . |
| 4,297,663 | 10/1981 | Seymour et al. . |
| 4,301,342 | 11/1981 | Castonguay et al. . |
| 4,360,852 | 11/1982 | Gilmore . |
| 4,368,444 | 1/1983 | Preuss et al. . |
| 4,375,021 | 2/1983 | Pardini et al. . |
| 4,375,022 | 2/1983 | Daussin et al. . |
| 4,376,270 | 3/1983 | Staffen . |
| 4,383,146 | 5/1983 | Bur . |
| 4,392,036 | 7/1983 | Troebel et al. . |
| 4,393,283 | 7/1983 | Masuda . |
| 4,401,872 | 8/1983 | Boichot-Castagne et al. . |
| 4,409,573 | 10/1983 | DiMarco et al. . |
| 4,435,690 | 3/1984 | Link et al. . |

(List continued on next page.)

FOREIGN PATENT DOCUMENTS

| | | |
|---|---|---|
| 819 008 A | 12/1974 | (BE) . |
| 12 27 978 | 11/1966 | (DE) . |
| 30 47 360 | 6/1982 | (DE) . |

(List continued on next page.)

*Primary Examiner*—Lincoln Donovan
*Assistant Examiner*—Tuyen T. Nguyen
(74) *Attorney, Agent, or Firm*—Cantor Colburn LLP; Carl B. Horton

(57) ABSTRACT

A clapper armature system for a circuit breaker includes a heater having a heater element and a pair of electrical conductors. The heater element is electrically connected to and disposed between the conductors. The conductors are spaced from the heater element to provide a pair of slots between the conductors and the heater element. A heat sensitive strip having one end electrically connected to at least one conductor is disposed proximate the heater element. A yoke has a pair of arms with each arm passing through a respective slot of the heater. The heater element and heat sensitive strip are disposed between the arms and provide a plurality of current paths between the arms. A clapper is disposed pivotally proximate the arms. The clapper pivots to the arms of the yoke to open a pair of separable contacts of the circuit breaker in response to a predetermined current passing through the heater and heat sensitive strip.

30 Claims, 8 Drawing Sheets

U.S. PATENT DOCUMENTS 4,467,297 8/1984 Boichot-Castagne et al. .
4,468,645 8/1984 Gerber-Gaillard et al. .
4,470,027 9/1984 Link et al. .
4,479,143 10/1984 Watanabe et al. .
4,488,133 12/1984 McClellan et al. .
4,492,941 1/1985 Nagel .
4,541,032 9/1985 Schwab .
4,546,224 10/1985 Mostosi .
4,550,360 10/1985 Dougherty .
4,562,419 12/1985 Preuss et al. .
4,589,052 5/1986 Dougherty .
4,595,812 6/1986 Tamaru et al. .
4,611,187 9/1986 Banfi .
4,612,430 9/1986 Sloan et al. .
4,616,198 10/1986 Pardini .
4,622,444 11/1986 Kandatsu et al. .
4,631,625 12/1986 Alexander et al. .
4,642,231 2/1987 Tedesco et al. .
4,644,438 2/1987 Puccinelli et al. .
4,649,247 3/1987 Preuss et al. .
4,658,322 4/1987 Rivera .
4,672,501 6/1987 Bilac et al. .
4,675,481 6/1987 Markowski et al. .
4,682,264 7/1987 Demeyer .
4,689,712 8/1987 Demeyer .
4,694,373 9/1987 Demeyer .
4,710,845 12/1987 Demeyer .
4,717,985 1/1988 Demeyer .
4,733,211 3/1988 Castonguay et al. .
4,733,321 3/1988 Lindeperg .
4,764,650 8/1988 Bur et al. .
4,768,007 8/1988 Mertz et al. .
4,780,786 10/1988 Weynachter et al. .
4,831,221 5/1989 Yu et al. .
4,870,531 9/1989 Danek .
4,883,931 11/1989 Batteux et al. .
4,884,047 11/1989 Baginski et al. .
4,884,164 11/1989 Dziura et al. .
4,900,882 2/1990 Bernard et al. .
4,910,485 3/1990 Bologeat-Mobleu et al. .
4,914,541 4/1990 Tripodi et al. .
4,916,420 4/1990 Bartolo et al. .
4,916,421 4/1990 Pardini et al. .
4,926,282 5/1990 McGhie .
4,935,590 6/1990 Malkin et al. .
4,937,706 6/1990 Schueller et al. .
4,939,492 7/1990 Raso et al. .
4,943,691 7/1990 Mertz et al. .
4,943,888 7/1990 Jacob et al. .
4,950,855 8/1990 Bolonegeat-Mobleu et al. .
4,951,019 8/1990 Gula .
4,952,897 8/1990 Barnel et al. .
4,958,135 9/1990 Baginski et al. .
4,965,543 10/1990 Batteux .
4,983,788 1/1991 Pardini .
5,001,313 3/1991 Leclerq et al. .
5,004,878 4/1991 Seymour et al. .
5,029,301 7/1991 Nebon et al. .
5,030,804 7/1991 Arbi .
5,057,655 10/1991 Kersusan et al. .
5,077,627 12/1991 Fraisse .
5,083,081 1/1992 Barrault et al. .
5,095,183 3/1992 Raphard et al. .
5,103,198 4/1992 Morel et al. .
5,115,371 5/1992 Tripodi .
5,120,921 6/1992 DiMarco et al. .
5,132,865 7/1992 Mertz et al. .
5,138,121 8/1992 Streich et al. .
5,140,115 8/1992 Morris .
5,153,802 10/1992 Mertz et al. .
5,155,315 10/1992 Malkin et al. .
5,166,483 11/1992 Kersusan et al. .
5,172,087 12/1992 Castonguay et al. .
5,178,504 1/1993 Falchi .
5,184,717 2/1993 Chou et al. .
5,187,339 2/1993 Lissandrin .
5,198,956 3/1993 Dvorak .
5,200,724 4/1993 Gula et al. .
5,210,385 5/1993 Morel et al. .
5,239,150 8/1993 Bolongeat-Mobleu et al. .
5,260,533 11/1993 Livesey et al. .
5,262,744 11/1993 Arnold et al. .
5,280,144 1/1994 Bolongeat-Mobleu et al. .
5,281,776 1/1994 Morel et al. .
5,296,660 3/1994 Morel et al. .
5,296,664 3/1994 Crookston et al. .
5,298,874 3/1994 Morel et al. .
5,300,907 4/1994 Nereau et al. .
5,310,971 5/1994 Vial et al. .
5,313,180 5/1994 Vial et al. .
5,317,471 5/1994 Izoard et al. .
5,331,500 7/1994 Corcoles et al. .
5,334,808 8/1994 Bur et al. .
5,341,191 8/1994 Crookston et al. .
5,347,096 9/1994 Bolongeat-Mobleu et al. .
5,347,097 9/1994 Bolongeat-Mobleu et al. .
5,350,892 9/1994 Rozier .
5,357,066 10/1994 Morel et al. .
5,357,068 10/1994 Rozier .
5,357,394 10/1994 Piney .
5,361,052 11/1994 Ferullo et al. .
5,373,130 12/1994 Barrault et al. .
5,379,013 1/1995 Coudert .
5,424,701 6/1995 Castonguary et al. .
5,438,176 8/1995 Bonnardel et al. .
5,440,088 8/1995 Coudert et al. .
5,449,871 9/1995 Batteux et al. .
5,450,048 9/1995 Leger et al. .
5,451,729 9/1995 Onderka et al. .
5,457,295 10/1995 Tanibe et al. .
5,467,069 11/1995 Payet-Burin et al. .
5,469,121 11/1995 Payet-Burin .
5,475,558 12/1995 Barjonnet et al. .
5,477,016 12/1995 Baginski et al. .
5,479,143 12/1995 Payet-Burin .
5,483,212 1/1996 Lankuttis et al. .
5,485,343 1/1996 Santos et al. .
5,493,083 2/1996 Olivier .
5,504,284 4/1996 Lazareth et al. .
5,504,290 4/1996 Baginski et al. .
5,510,761 4/1996 Boder et al. .
5,512,720 4/1996 Coudert et al. .
5,515,018 5/1996 DiMarco et al. .
5,519,561 5/1996 Mrenna et al. .
5,534,674 7/1996 Steffens .
5,534,832 7/1996 Duchemin et al. .
5,534,835 7/1996 McColloch et al. .
5,534,840 7/1996 Cuingnet .
5,539,168 7/1996 Linzenich .
5,543,595 8/1996 Mader et al. .
5,552,755 9/1996 Fello et al. .
5,581,219 12/1996 Nozawa et al. .
5,604,656 2/1997 Derrick et al. .
5,608,367 3/1997 Zoller et al. .
5,784,233 7/1998 Bastard et al. .
5,793,026 * 8/1998 Kolberg et al. ..... 335/172
5,872,495 * 2/1999 DiMarco et al. ..... 335/35

FOREIGN PATENT DOCUMENTS 38 02 184 8/1989 (DE) .
38 43 277 6/1990 (DE) .

| | | |
|---|---|---|
| 44 19 240 | 1/1995 | (DE) . |
| 0 061 092 | 9/1982 | (EP) . |
| 0 064 906 | 11/1982 | (EP) . |
| 0 066 486 | 12/1982 | (EP) . |
| 0 076 719 | 4/1983 | (EP) . |
| 0 117 094 | 8/1984 | (EP) . |
| 0 140 761 | 5/1985 | (EP) . |
| 0 174 904 | 3/1986 | (EP) . |
| 0 196 241 | 10/1986 | (EP) . |
| 0 224 396 | 6/1987 | (EP) . |
| 0 235 479 | 9/1987 | (EP) . |
| 0 239 460 | 9/1987 | (EP) . |
| 0 258 090 | 3/1988 | (EP) . |
| 0 264 313 | 4/1988 | (EP) . |
| 0 264 314 | 4/1988 | (EP) . |
| 0 283 189 | 9/1988 | (EP) . |
| 0 283 358 | 9/1988 | (EP) . |
| 0 291 374 | 11/1988 | (EP) . |
| 0 295 155 | 12/1988 | (EP) . |
| 0 295 158 | 12/1988 | (EP) . |
| 0 309 923 | 4/1989 | (EP) . |
| 0 313 106 | 4/1989 | (EP) . |
| 0 313 422 | 4/1989 | (EP) . |
| 0 314 540 | 5/1989 | (EP) . |
| 0 331 586 | 9/1989 | (EP) . |
| 0 337 900 | 10/1989 | (EP) . |
| 0 342 133 | 11/1989 | (EP) . |
| 0 367 690 | 5/1990 | (EP) . |
| 0 371 887 | 6/1990 | (EP) . |
| 0 375 568 | 6/1990 | (EP) . |
| 0 394 144 | 10/1990 | (EP) . |
| 0 394 922 | 10/1990 | (EP) . |
| 0 399 282 | 11/1990 | (EP) . |
| 0 407 310 | 1/1991 | (EP) . |
| 0 452 230 | 10/1991 | (EP) . |
| 0 555 158 | 8/1993 | (EP) . |
| 0 567 416 | 10/1993 | (EP) . |
| 0 595 730 | 5/1994 | (EP) . |
| 0 619 591 | 10/1994 | (EP) . |
| 0 665 569 | 8/1995 | (EP) . |
| 0 700 140 | 3/1996 | (EP) . |
| 2 410 353 | 6/1979 | (FR) . |
| 2 512 582 | 3/1983 | (FR) . |
| 2 553 943 | 4/1985 | (FR) . |
| 2 592 998 | 7/1987 | (FR) . |
| 2 682 531 | 4/1993 | (FR) . |
| 2 697 670 | 5/1994 | (FR) . |
| 2 699 324 | 6/1994 | (FR) . |
| 2 714 771 | 7/1995 | (FR) . |
| 2 233 155 | 1/1991 | (GB) . |
| 92/00598 | 1/1992 | (WO) . |
| 92/05649 | 4/1992 | (WO) . |
| 94/00901 | 1/1994 | (WO) . |

* cited by examiner

CLAPPER ARMATURE SYSTEM FOR A CIRCUIT BREAKER

BACKGROUND OF THE INVENTION

This invention relates to electrical equipment protective devices generally and more particularly, to a circuit breaker, operating under low current conditions, that includes a clapper armature system for tripping the circuit breaker in response to a short circuit condition.

Circuit breakers typically provide protection against persistent overcurrent conditions and against very high currents produced by short circuits. This type of protection is provided in many circuit breakers by a thermal-magnetic trip mechanism having a thermal trip portion and a magnetic trip portion, similar to that shown in FIG. 1. The trip mechanism 10 of FIG. 1 includes a conductor 12 that carries current from a load terminal to the pair of contacts for interrupting current in response to an overcurrent or short circuit condition.

The thermal trip portion 13 of the trip mechanism 10 includes a bimetallic strip 14 having one end 16 attached to the conductor 12. The bimetallic strip is formed of two metals having different coefficients of expansion such that a free end 15 of the bimetallic strip bends or deflects counterclockwise when the temperature exceeds a predetermined temperature. As shown, the bimetallic strip 14 is disposed adjacent and substantially parallel to a portion of the conductor 12. When an overcurrent condition occurs, the conductor generates heat, which in turn increases the temperature of the bimetallic strip. If the temperature of the bimetallic strip exceeds the predetermined set point, the free end 15 of the bimetallic strip deflects to actuate a linkage interconnected to the pair of separable contacts. The linkage then opens the pair of contacts to interrupt the current and thereby, protect the load from the overcurrent condition.

The magnetic trip portion 17 of the trip mechanism 10 includes a clapper 18 having one end 20 pivotally connected to the housing of the circuit breaker and a free end 22 that engages the linkage to open the pair of separable contacts in response to a short circuit condition. As shown in FIG. 1, the clapper is disposed adjacent the bimetallic strip 14. A generally U-shaped yoke 24 is disposed about the conductor 12 and the bimetallic strip. Arms 26 and 28 of the yoke extend proximate the clapper 18. When a short circuit condition occurs, a magnetic field in the yoke is generated proportional to the current passing through the conductor. When the magnetic force attracting the clapper 18 is greater than a predetermined level, the clapper pivots clockwise to engage the yoke 24 and actuate the linkage to open the contacts.

The trip mechanism 10 of FIG. 1 is commonly used to protect loads that operate under high current conditions, but not for low operating current conditions. Generally these thermal-magnetic trip mechanisms 10 are unable to afford protection with electric current in the range of 16 to 60 amperes. Such current level is unable to induce a magnetic field of the intensity required for clapper movement when short current protection is required. Typically, the magnetic trip portion 17 of current trip mechanisms 10 for circuit breakers includes a solenoid that is substantially more sensitive to the low current operating conditions.

BRIEF SUMMARY OF THE INVENTION

In an exemplary embodiment of the invention a clapper armature system for a circuit breaker includes a heater having a heater element and a pair of electrical conductors.

The heater element is electrically connected to and disposed between the conductors. The conductors are spaced from the heater element to provide a pair of slots between the conductors and the heater element. A heat sensitive strip having one end electrically connected to at least one conductor is disposed proximate the heater element. A yoke has a pair of arms with each arm passing through a respective slot of the heater. The heater element and heat sensitive strip are disposed between the arms and provide a plurality of current paths between the arms. A clapper is disposed pivotally proximate the arms. The clapper pivots to the arms of the yoke to open a pair of separable contacts of the circuit breaker in response to a predetermined current passing through the heater and heat sensitive strip.

BRIEF DESCRIPTION OF THE DRAWINGS

Referring now to the drawings wherein like elements are numbered alike in the several Figures.

DETAILED DESCRIPTION OF THE INVENTION

Figure 1:
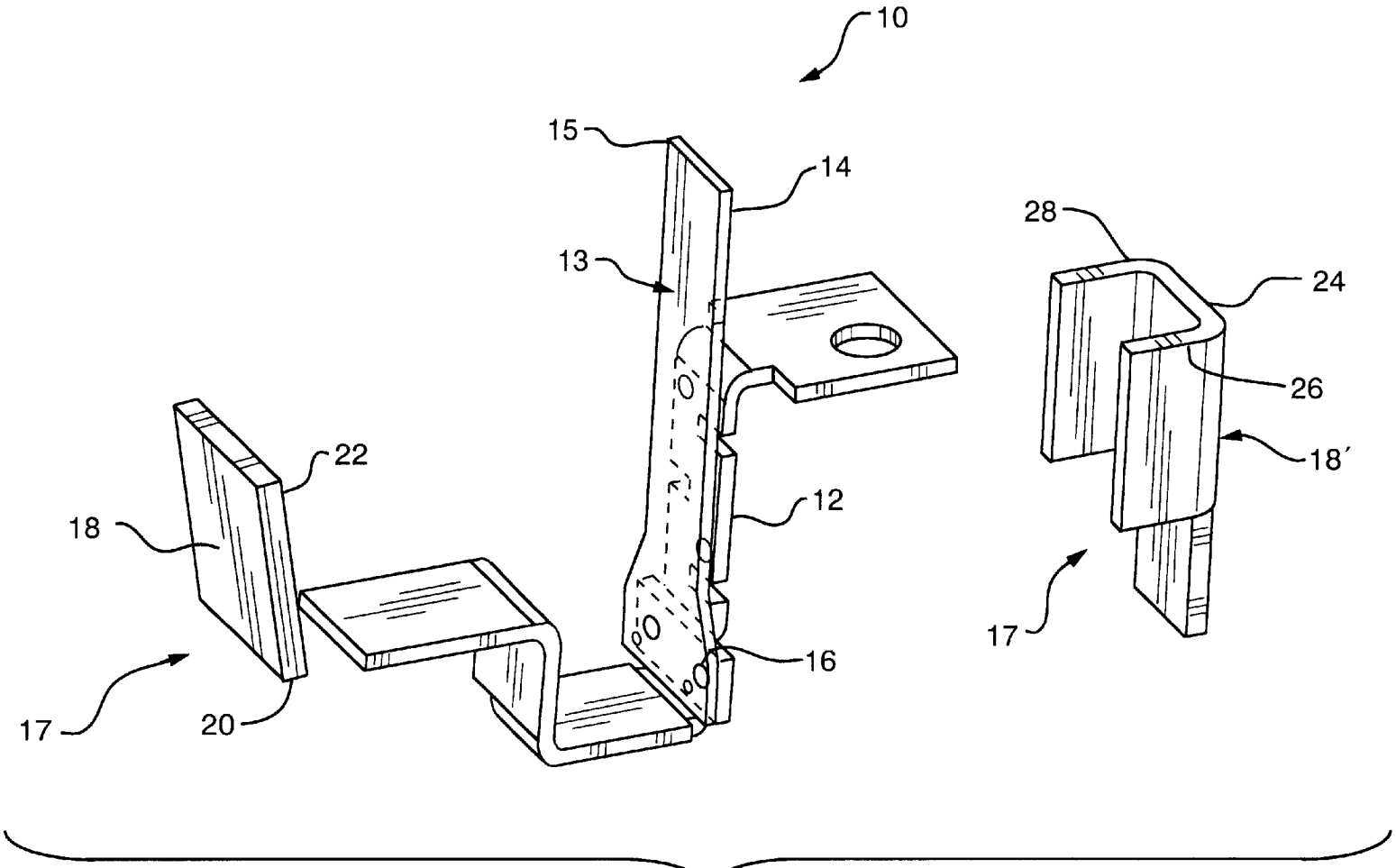
FIG. 1 (PRIOR ART)
FIG. 1 is an exploded perspective view of the thermal-magnetic trip portion of the prior art.
Figure 2:
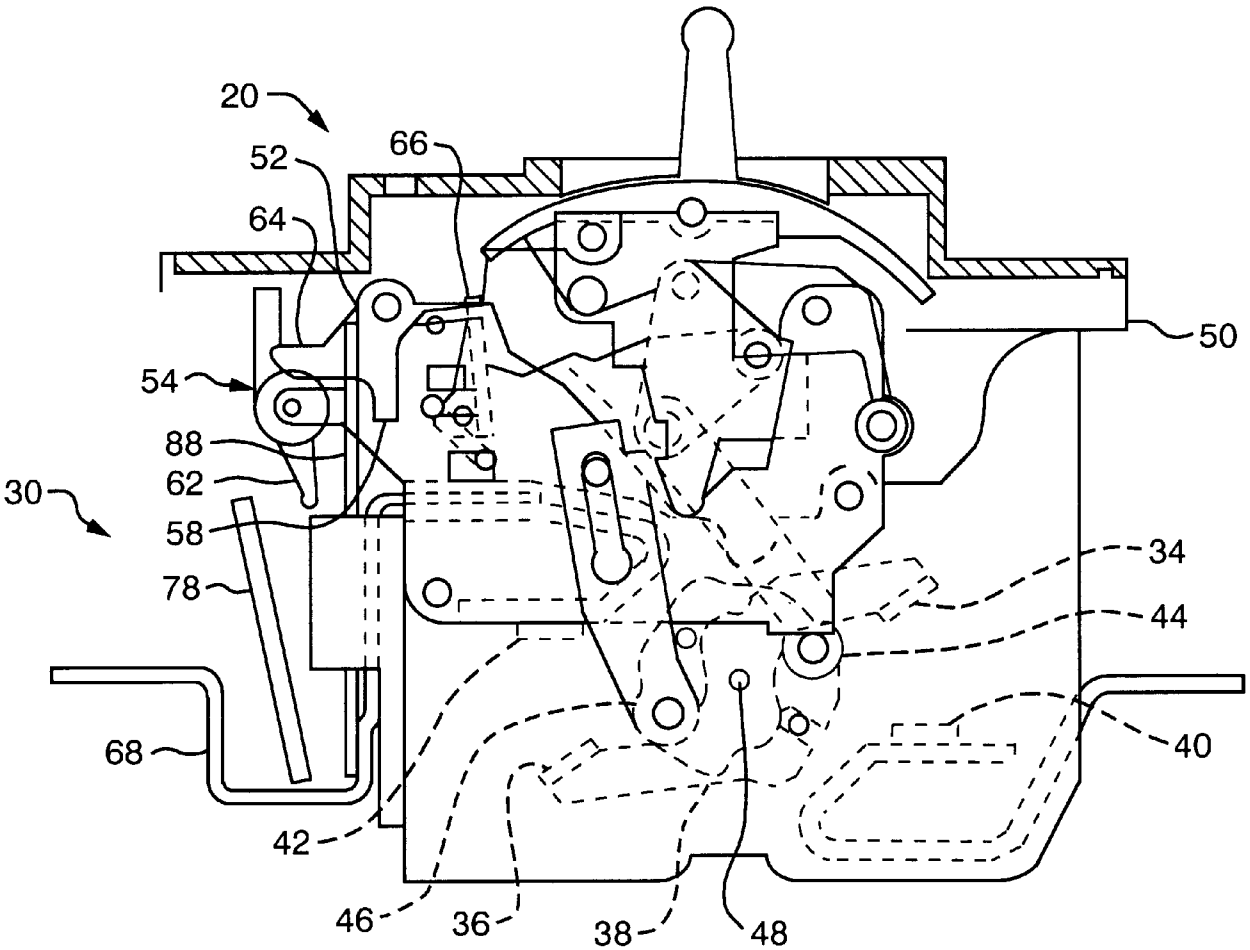
FIG. 2 is a cross-sectional view of an exemplary circuit breaker including a thermal-magnetic trip mechanism embodying the present invention.

Referring to FIG. 2, an embodiment of a circuit breaker, generally shown at 20, including a clapper armature system 30 is shown. Circuit breaker 20 includes a pair of rotary contacts 34, 36, disposed on opposite ends of rotating contact arm 38. The rotary contacts 34, 36 are in opposing alignment to fixed contacts 40, 42 respectively. The rotating contact arm is mounted pivotally to the circuit breaker frame at 48. The rotating contact arm 38 engages a circuit breaker operating mechanism at a pair of pivotal engagements 44,46 that are interposed between the rotating contacts.

The operating mechanism includes a series of linkages and levers 50 interconnecting the rotating contact arm 38 and the clapper armature system 30. Two levers 52, 54 cooperate with the clapper armature system 30 to actuate a trip latch 66 of operating mechanism 50 and open the rotatory contacts 34,36.

Levers 52, 54 of operating mechanism 50 are pivotally mounted to the circuit breaker frame. When heated, a heat sensitive strip, for example a bimetallic strip 88 engages an arm 58 of the first lever 52 thusly rotating the first lever and releasing the trip latch 66. Second lever 54 rotatingly engages another arm 64 of the first lever 52. During a short current condition a clapper 78 rotates and engages an arm 62 of the lever 54 thus rotating levers 52, 54 to actuate the trip latch 66, which then rotates the contact arm 38 to separate the contacts 34, 36, 40, 42 to interrupt current.

Figure 3:
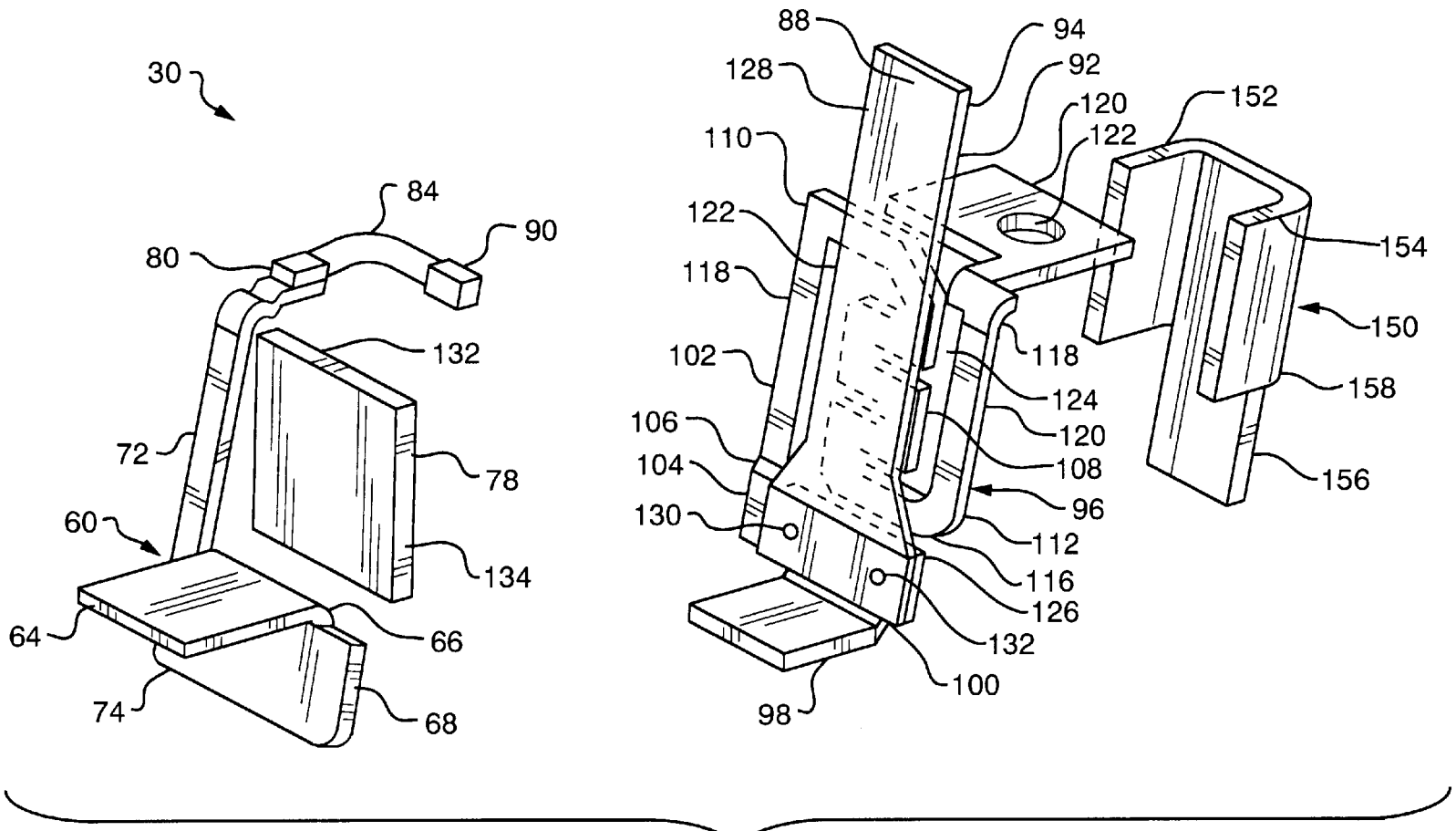
FIG. 3 is an exploded, perspective view of the thermal-magnetic trip mechanism of the present invention.

As shown in FIG. 3, the clapper armature system 30 includes an input terminal 60 mounted to the circuit breaker frame. The input terminal 60 includes a generally horizontal tab 64 that provides an electrical interface to the load or source. At one end 66 of the horizontal tab 64, a vertical member 68 depends downwardly. An L-shaped extension bar 72 extends upward from vertical member 68 at one side 74. The length of the extension bar extends above the clapper 78 to permit free movement of the clapper, during a short-circuit condition which will be described in greater detail hereinafter. One end of an electrically conductive braid 84 is attached to an upper free end 80 of the extension bar 72, such as by brazing, welding or soldering. An other end 90 of the braid 84 is attached to an inner surface 92 of a free end 94 of the bimetallic strip 88 to be described in greater detail hereinafter.

Heater device 96 is constructed from a material, such as an alloy, having conductive and resistive heating properties. The heater device is integrally manufactured by a process well known in the art, e.g. stamping or forging. Thus, although integrally manufactured and constructed of a single material, the heater device 96 comprises a complex shape for mounting to the frame of the circuit breaker and to provide a plurality of current paths.

The heater device 96 includes a horizontal mounting tab 98 for securing the heater device to the frame of the circuit breaker by means well known in the art. The heater device includes a vertical mounting tab 100 that extends upwardly from the horizontal mounting tab 98. The vertical mounting tab 100 provides a mounting surface for attaching one end of the bimetallic strip 88 thereto. The vertical mounting tab 100 defines a first plane of the heater device 96. An inlet conductor 102 extends upward from one end 104 of the vertical mounting tab 100 and angularly steps inward away from the bimetallic strip 88 at 106. The inlet conductor defines a second planar surface, spaced a predetermined distance from the first planar surface thereby defining a space 232 (See FIG. 5) between the bimetallic strip 88 and the heater element 108 to be described hereinafter. Inlet conductor 102 extends upward a predetermined distance that is less than the length of the bimetallic strip 88 to prevent any interference with the operating mechanism 20 (FIG. 2).

A heater element 108 extends from an upper end 110 of the inlet conductor 102 adjacent the inlet conductor. The heater element 108 forms a serpentine shape extending downward towards the vertical mounting tab 100 and having a length approximately equal to the length of the inlet conductor 102. The heater element 108 has a width substantially the same as the width of the bimetallic strip 88 and is disposed centrally with respect to the bimetallic strip.

An outlet conductor 112 of a predetermined length, substantially equal to the length of the heater element 108, extends upward from a lower end 116 of the heater element substantially parallel to the inlet conductor 102 and heater element 108. A top end 118 of outlet conductor 112 comprises a tab 120 depending generally horizontally therefrom. Tab 120 is generally planar shaped having a hole 122 defined therethrough. The tab 120 is dispositioned in electrical contact with circuit breaker components carrying load current.

As described hereinbefore, inlet conductor 102 and outlet conductor 112 are dispositioned vertically and the heater element 108 is interposed therebetween. The vertical portions 118, 120 of conductor 102, 112 are spaced from the heater 108 a predetermined distance to provide slots 122, 124 therebetween for receiving arms 152, 154 of a yoke 150 which will be described in greater detail herineafter.

The bimetallic strip 88 comprises at least two metals with different coefficients of expansion selected to bend in response to a temperature increase. The metals comprising the strip are electrically conducting in the combination.

A lower portion 126 of the bimetallic strip 88, depends from the upper portion 128 of the bimetallic strip 88 and is substantially wider than the upper portion 128. Two tack welds 130, 132 attach the lower portion 126 of the bimetallic strip 88 to the vertical mounting tab 100. However, it is to be appreciated that other fastening means well known in the art can describe the attachment e.g. rivets, pins and screws.

Bimetallic strip 88 is generally rectangular having substantially the same width as the heater element 108, both being sized to be dispositioned between the arms 152, 154 of the yoke 150 (to be described hereinafter). An upper end 94 of the bimetallic strip 88 extends above the heater element 108 for engaging the operating mechanism 20 as described hereinbefore. The bimetallic strip 88 disengages a lever 52 connected to a trip latch 66 (See FIG. 2) when the upper end 94 of the bimetallic strip 88 bends in response with the heat generated by current in the heater element 108. The bimetallic strip 88 is positioned approximate the heater element 108 and substantially in parallel opposition to the heater element.

Further, the other end 90 of the braid 84 is attached to the inner surface 92 of the free end 94 of the bimetallic strip 88 by a means well known in the art such as soldering or welding. Between the upper free end 80 of the extension bar 72 and the other end 90, the braid is flexibly disposed for allowing free movement of the bimetallic strip while maintaining continuous electrical contact.

The yoke 150 comprises a pair of arms 152, 154 forming an arcuate body 158 having a planar rectangular mounting base 156 defined therebetween. The mounting base extends a predetermined length from the accurate body 158 and is attached to the circuit breaker housing to mount the yoke.

Figure 4:
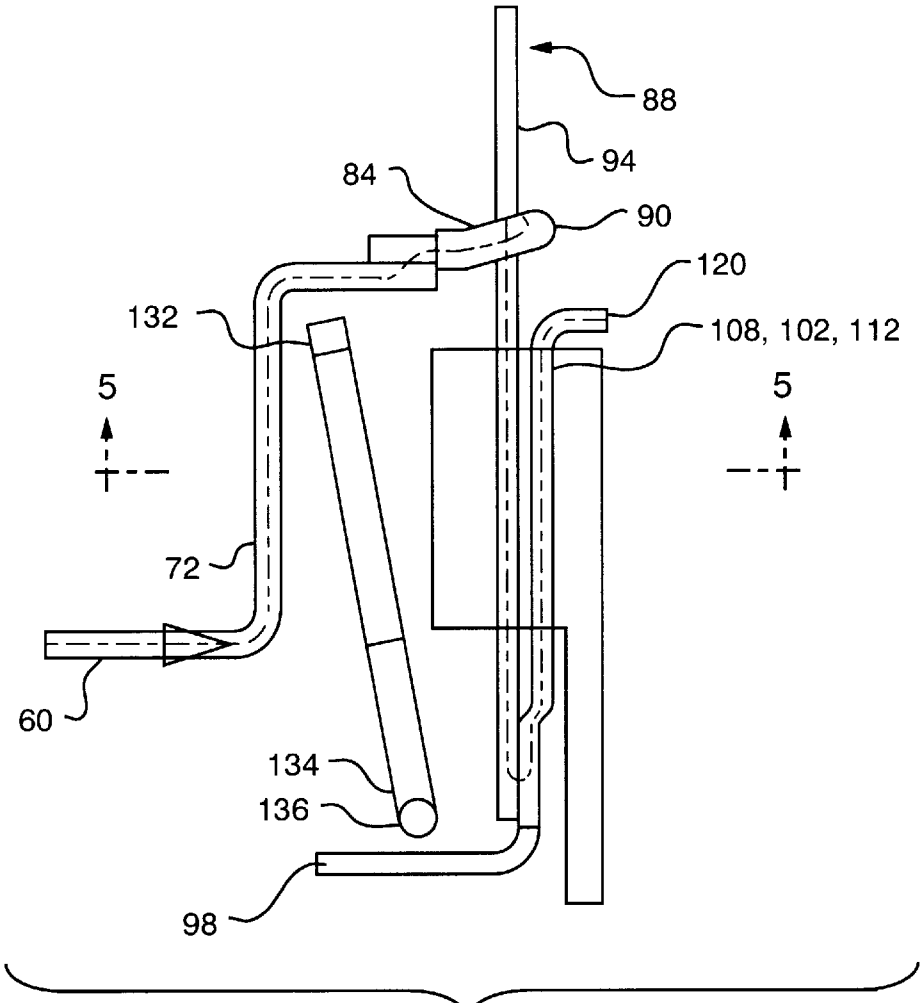
FIG. 4 is a side elevational view of the thermal-magnetic trip mechanism of FIG. 3.
Figure 5:
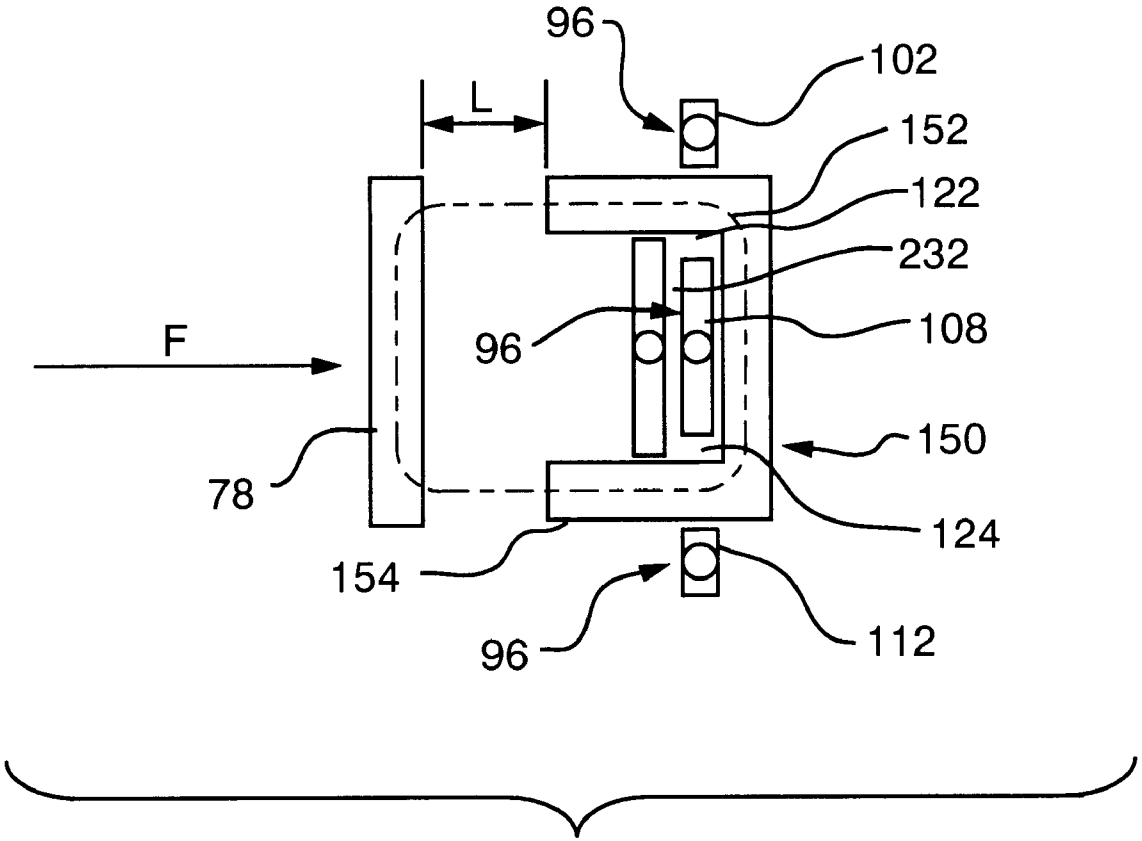
FIG. 5 is a cross-sectional view of the thermal-magnetic trip mechanism of FIG. 4 taken along line 5—5 illustrating current flow and electromagnetic force disposed therein.

As best shown in FIGS. 4 and 5, the arms 152 and 154 pass through the slots 122, 124, respectively disposed between the heater element 108 and the conductors 102, 112 respectively. The arms 152 and 154 extend through the slots a predetermined distance to define a predetermined air gap L (see FIG. 5) proximate the clapper 78. The yoke is formed of a magnetically permeable material to provide a path for a flux induced magnetic field. One skilled in the art will appreciate that the position of the clapper with respect to the arms 152, 154 of the yoke 150 affect the magnetic attraction and thus the setpoint of the magnetic overcurrent trip setpoint.

Referring to FIGS. 3 and 4, one end 134 of the clapper 78 is pivotally mounted to the circuit breaker frame at 136 intermediate vertical member 68 and the bimetallic strip 88 (see FIG. 2). An opposing end 132 of the clapper is positioned above the pivot a predetermined length for engaging the lever 54 of the operating mechanism 50 (FIG. 2) upon clockwise rotation of the clapper.

FIGS. 4 and 5 illustrate the path of the current I through the clapper armature system 30 and the electro mechanical principle of the assembly. Current I enters input terminal 60 and passes through the L-shaped extension bar 72 and hence through the braid 84, entering the bimetallic strip 88 at the other end 90 of the braid 84. The current flows downwardly through the bimetallic strip 88 and is conducted upwardly in inlet conductor 102 to the serpentine shaped heater element 108. In the heater element 108, the current is again conducted downwardly exiting to the outlet conductor 112 where the current is conducted upwardly to the tab 120 and out of the heater device 96.

As best shown in FIG. 5 a further illustration of the current flow in the heater device 96 depicts the interaction with the yoke 150 which generates an magnetic field in the yoke. Current flowing into the figure is depicted by a "." and current flowing out of the figure is depicted by an "x." During normal operation of the trip mechanism, current flow in inlet and outlet conductors 102, 112 flows "into the figure." Current flows in the bimetallic strip 88 and the heater element 108 "out of the figure", i.e., opposite to the current flow in the conductors 102, 112.

In accordance with scientific principles, the flux within each slot 122,124 is a sum of individual fluxes within each slot. As is well known in the art, the direction of a magnetic field in relation to current flow is described by the "right hand rule". The strength of magnetic fields produced in the same direction are added by the rules of vector addition. Similarly, the strength of magnetic fields produced in opposite directions is subtracted. This same rule applies to currents that are induced by magnetic fields since the currents and fields are directly linked, and directly proportional to each other. Thus, by applying the right hand rule in FIG. 5 it follows that the fluxes from the bimetallic strip 88, the heater element 108, the inlet conductor 102 and outlet conductor 112 are added in the slots 122, 124.

The flux in the slots 122, 124 induces a magnetic field within the arms of the yoke 152, 154 which are dispositioned within the slots. The intensity of the magnetic field and the resulting magnetic attraction of the clapper 78 is thus proportional to current flow through the heater device 96 and bimetallic strip 88. Because the flux in the slots is the sum of parallel current paths, the result is that lower currents are sufficient to generate a magnetic field to attract the clapper 78. This allows the clapper armature system 30 to be used for circuit breakers carrying low current. The size of the slots, the size of the arms, the geometry of the arms and the materials of construction are other factors which affect the strength of the induced magnetic field in the yoke 150.

In the operation of the clapper armature system 30 when a short circuit fault condition occurs in the load lines, the current increases rapidly resulting in a proportional increase in flux surrounding the aforementioned components. As explained hereinabove, because the intensity of flux is additive, the flux resulting within the yoke 150 is proportional to the flux in the conductors 102,108, the heater element 108 and the bimetallic strip 88.

The magnetic force in the arms 152, 154 acting through the gap L attracts the clapper 78. At a predetermined level the clapper rotates clockwise to engage the yoke 150 and actuates a lever 62 (see FIG. 2) which opens the pairs of contacts 34, 40 and 36, 42 to interrupt the current and thereby, protect the load from the overcurrent condition as described hereinbefore.

The bimetallic strip 88 provides the thermal trip for an overcurrent condition. Increased current generates heat in the bimetallic strip and in the heater element 108 which further heats-up the bimetallic strip 88. The heat that is generated is a function of the magnitude and duration of the overcurrent condition. The trip resulting from the bimetallic strip has an inverse time characteristic. Thus, higher overcurrent conditions result in shorter trip times.

When the temperature of the bimetallic strip 88 exceeds the predetermined set point, the free end 94 of the bimetallic strip deflects to actuate a lever 52 (see FIG. 2) which open the pairs of contacts 34, 40 and 36, 42 to interrupt the current and thereby, protect the load from the overcurrent condition as described hereinbefore.

Figure 6:
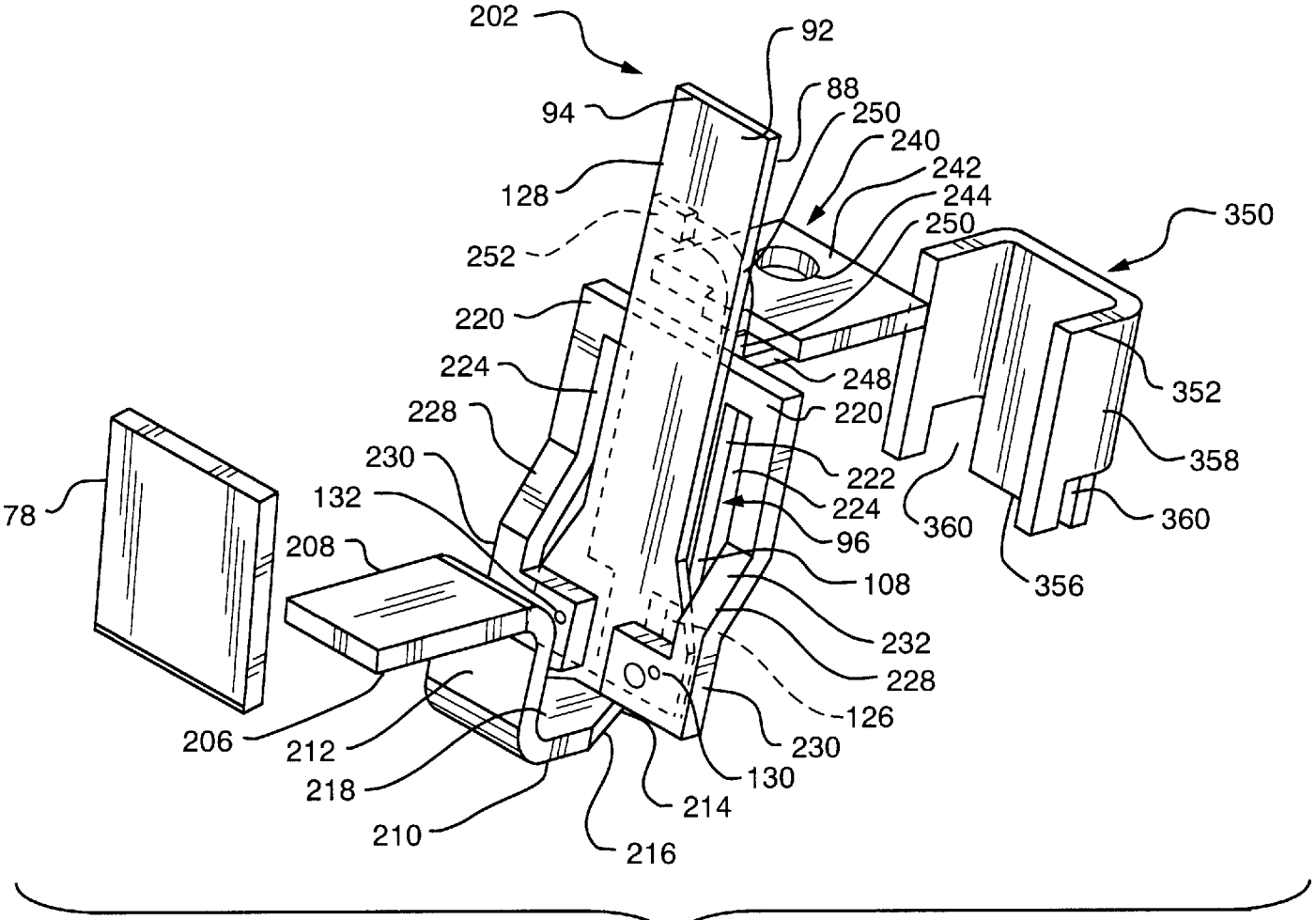
FIG. 6 is an exploded perspective view of an alternate embodiment of the thermal-magnetic trip mechanism of the present invention.

As shown in FIG. 6, an alternate embodiment of the clapper armature system is shown generally at 202. The clapper armature system includes a heater device 96 constructed from a single stamping or forging and constructed from materials as described hereinabove.

A mounting tab 206 comprises two horizontal portions 208,210 and a vertical portion 212 downwardly depending from the first horizontal portion 208 and disposed between the horizontal portions 208, 210. The first horizontal portion 208 is attached to a load carrying conductor and secured to the frame of the circuit breaker (not shown).

A tongue 214 extends in an upward direction from a tapered end 216 of the second horizontal portion 210. A heater element 108 and the vertical portion 212 of the mounting tab 206 form a cavity 218 therebetween for locating a clapper 78. The heater element 108 is substantially rectangular and has a width substantially equal to the width of a bimetallic element 88.

L-shaped conductors 220 extend downwardly a predetermined distance from opposing edges 222 of the heater element 108. This distance is less than the length of the bimetallic strip 88 (to be described hereinafter) to allow the bimetallic strip to extend above the heater element 108 in order to prevent interference with the operating mechanism 20 (see FIG. 2). The L-shaped conductors 220 are spaced from the opposing edges 222 of the heat element 108 to provide slots 224 between the heater element and each L-shaped conductor 220 for receiving arms 352 of a yoke 350 which will be described in greater detail herineafter.

The L-shaped conductors 220 and the heater element 108 define a first plane of the heater device 96. Each conductor 220 includes a portion 228, that angularly steps inward towards the bimetallic strip 88 and which defines a second planar surface, spaced a predetermined distance from the first planar surface.

A lower portion 230 of each L-shaped conductor 220 depends from portion 228 and is dispositioned facing the opposing lower portion thereof. With the bimetallic strip 88 attached to the lower portions 230, the space 232 between the bimetallic strip 88 and the heater element 108 is formed.

The bimetallic strip 88 comprises at least two metals as substantially described hereinabove. A lower portion 126 of the bimetallic strip 88, depends from the upper portion 128 of the bimetallic strip 88 and is substantially wider than the upper portion. A tack weld 130, 132 attaches the lower portion 126 of the bimetallic strip 88 to each L-shaped portion 230. However, it is to be appreciated that other fastening means well known in the art can describe the attachment e.g. rivets, pins and screws.

Bimetallic strip 88 is generally rectangular having substantially the same width as the heater element 108, both being sized to be positioned between the arms 352 of the yoke 350 (to be described hereinafter). An upper end 94 of the bimetallic strip 88 extends above the heater element 108 for engaging the operating mechanism 20 as described hereinbefore. The bimetallic strip 88 is positioned proximate the heater element 108 and substantially in parallel opposition to the heater element. The upper end 94 of the bimetallic strip 88 cooperates with the circuit breaker operating mechanism substantially as described hereinbefore in operation of the other embodiment.

The clapper armature system 202 includes an output terminal 240 mounted to the circuit breaker frame. The output terminal 240 includes a generally horizontal tab 242 including a hole 244 for attachment and further provides an electrical interface to the load or source.

A braid 250 that is electrically conductive extends upward from an extended step 248 of he horizontal tab 242. One end of the braid 250 is attached proximate the step 248, such as by brazing, welding or soldering. An other end 252 of the braid is attached to an inner surface 92 proximate the free end 94 of the bimetallic 88 strip by a means well known in the art such as soldering or welding. Between the step 248 and the other end 250, the braid is flexibly disposed for allowing free movement of the bimetallic strip 88 while maintaining continuous electrical contact.

The yoke 350 comprises a pair of arms 352 forming an arcuate body 358 having a planar rectangular mounting base 356 defined therebetween and comprising a magnetically permeable material as substantially described in the other embodiment hereinbefore. The lower edge of each arm defines a rectangular cutout 360. In its assembled configuration, the arms of the yoke are positioned within their respective slot 224 with the lower portion 230 inserted within each cutout 360 respectively. The yoke 350 is dispositioned below the tab 242. The mounting base 356 extends a predetermined length from the arms 352 and is attached to the circuit breaker housing to mount the yoke. The description of the clapper 78 is substantially as described hereinbefore.

Figure 7:
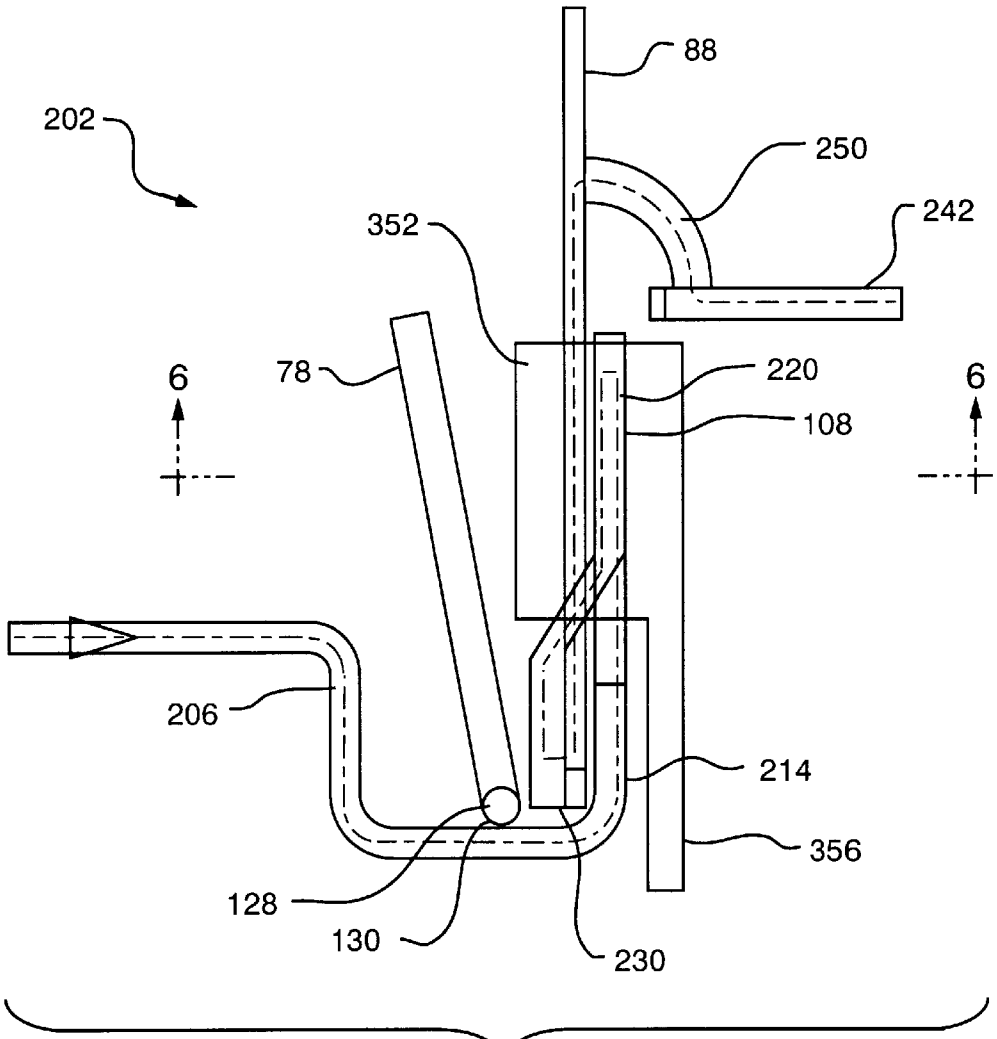
FIG. 7 is a side elevational view of the thermal-magnetic trip mechanism of FIG. 6.
Figure 8:
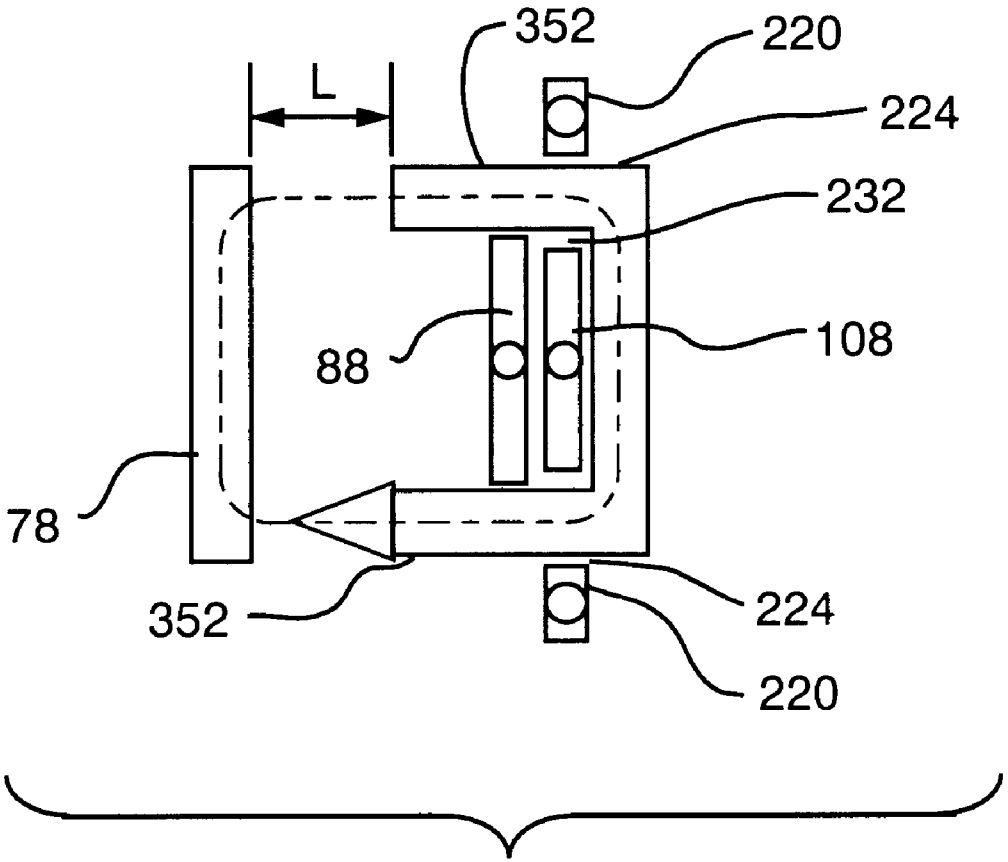
FIG. 8 is a cross-sectional view of the thermal-magnetic trip mechanism of FIG. 7 taken along line 6—6 illustrating current flow and electromagnetic force disposed therein.

As best shown in FIGS. 7 and 8, the arms 352 pass through the slots 224 disposed between the heater element 108 and the conductors 220 respectively. The arms 352 extend through the slots respectively a predetermined distance to define a predetermined air gap L proximate the clapper 78.

FIGS. 7 and 8 illustrate the path I of the current through the clapper armature system 202 and the electro mechanical principle of the assembly. Current I enters the mounting tab 206 and then enters the tongue 214 of the heater element 108. The current flows upward through the heater element 108 and enters both conductors 220 thereby flowing downward to the lower portion 230 and then into the bimetallic strip 88. The current flows upwardly through the bimetallic strip and is conducted to the braid 250 through the tab 242 and out of the heater device 96.

As best shown in FIG. 8 a further illustration of the current flow in the heater device 96 depicts the interaction with the yoke 350 which generates an magnetic field in the yoke. Current flowing into the figure is depicted by a "." and current flowing out of the figure is depicted by an "x". During normal operation of the trip mechanism, current flow in the conductors 220 is "out of the figure". Current flow in the bimetallic strip 88 and the heater element 108 is "into the figure", i.e., opposite to the current flow in the conductors.

In accordance with scientific principles, the flux within each slot 224 is a sum of individual fluxes within each slot as described hereinbefore and the operation of this second embodiment is substantially as described with respect to the other embodiment hereinabove.

The advantage of the clapper-armature system is that the multiple current flux path defined by the bimetallic strip and the two conductors results in higher induced magnetism levels in the yoke than is reached in similar clapper devices without multiple current conduction. The multiplication of the induced field strength increases the clapper sensitivity permitting a thermal-electric overcurrent clapper device to be used in low current applications, typically below 60 amperes, replacing more costly solenoid configurations.

In addition, the device uses the heater punching to construct both instantaneous overcurrent protection and time-delay (thermal) overcurrent protection resulting in further economies by eliminating the need for separate trip devices for each function.

Finally, the device is suitable for use in high current trip settings thereby providing manufacturing economies of scale by eliminating assembly lines for other devices such as solenoids.

While exemplary embodiments have been shown and described, various modifications and substitutions may be made thereto without departing from the spirit and scope of the invention. Accordingly, it is to be understood that the present invention has been described by way of illustration and not limitation.

What is claimed is:

1. A clapper armature system for a circuit breaker; the clapper armature system comprising:

a heater comprising a heater element and first and second electrical conductor, the heater element electrically connected to and disposed between the first and second conductors, so that the first and second conductors each extend along a respective side of said heater element, have at least substantially the same length as said heater element, and are spaced from the heater element to provide a pair of slots between said heater element and said first and second electrical conductors;

heat sensitive strip disposed proximate the heater element, the heat sensitive strip having a first end electrically connected to at least one on the first and second conductors;

a yoke having a pair of arms, each arm passing through a respective slot of the heater, wherein the heater element and heat sensitive strip are disposed between the arms to provide a plurality of current paths between the arms and said first and second electrical conductors are not between the arms; and a clapper disposed pivotally proximate the arms, wherein the clapper pivots to the arms of the yoke to open a pair of separable contacts of the circuit breaker in response to a predetermined current passing through the heater and heat sensitive strip.

2. The clapper armature system of claim 1, wherein the heater comprises a single punching.

3. The clapper armature system of claim 1, wherein the heater element has a rectangular shape.

4. The clapper armature system of claim 1, wherein a first end of the first and second conductors are electrically connected to a first end of the heater element.

5. The clapper armature system of claim 4, wherein a second end of the first and second conductors are electrically connected to the first end of the heat sensitive strip.

6. The clapper armature system of claim 5 further comprising:

an input tab electrically connected to the second end of the heater element for conducting current to the heater.

7. The clapper armature system of claim 6, wherein the second end of the heater element has a width less than a width of the first end of the heater element.

8. The clapper armature system of claim 5 further comprising:

an output tab; and a flexible conductor electrically connected between the second end of the heat sensitive strip and the output tab.

9. The clapper armature system of claim 8, wherein the flexible conductor comprises a braided wire.

10. The clapper armature system of claim 5, wherein the first and second conductors are bent outwardly from the heater element to space the heat sensitive strip a predetermined distance from the heater element.

11. The clapper armature system of claim 1, wherein the heater element has a serpentine shape.

12. The clapper armature system of claim 1, wherein a first end of the first conductor is electrically connected to a first end of the heater element and a first end of the second conductor is electrically connected to a second end of the heater element.

13. The clapper armature system of claim 12, wherein a second end of the first conductor is electrically connected to the first end of the heat sensitive strip.

14. The clapper armature system of claim 13, wherein the first conductor is bent outwardly from the heater element to space the heat sensitive strip a predetermined distance from the heater element.

15. The clapper armature system of claim 12 further comprising:

an output tab electrically connected to a second end of the second conductor.

16. The clapper armature system of claim 1 further comprising:

an input tab including an extension extending a predetermined distance; and a flexible conductor electrically connected between the extension of the input tab and a second end of the heat sensitive strip.

17. The clapper armature system of claim 16, wherein the flexible conductor comprises a braided wire.

18. The clapper armature system of claim 1 wherein the heat sensitive strip is a bimetallic strip.

19. A circuit breaker for selectively interrupting current to a protected load; the circuit breaker comprising:

a pair of separable contacts for interrupting the current to the protected load;

an operating mechanism engaging the pair of separable contacts; and a clapper armature system for actuating the operating mechanism to separate the pair of separable contacts in response to a fault condition; the clapper armature system including:

a heater comprising a heater element and first and second electrical conductors, the heater element electrically connected to and disposed between the first and second conductors, so that the first and second conductors each extend along a respective side of said heater element, have at least substantially the same length as said heater element, and are spaced from the heater element to provide a pair of slots between said heater element and said first and second electrical conductors;

a heat sensitive strip disposed proximate the heater element, the heat sensitive strip having a first end electrically connected to at least one on the first and second conductors, and a second end for engaging the operating mechanism, wherein the heat sensitive strip flexes when heated to a predetermined temperature to actuate the operating mechanism;

a yoke having a pair of arms, each arm passing through a respective slot of the heater, wherein the heater element and heat sensitive strip are disposed between the arms to provide a plurality of current paths between the arms and said first and second electrical conductors are not between the arms; and a clapper disposed pivotally proximate the arms, wherein the clapper pivots to the arms of the yoke to open said pair of separable contacts of the circuit breaker in response to a predetermined current passing through the heater and heat sensitive strip, the clapper engaging the operating mechanism, wherein pivoting of the clapper actuates the operating mechanism.

20. The circuit breaker of claim 19, wherein a first end of the first and second conductors are electrically connected to an upper end of the heater element.

21. The circuit breaker of claim 20, wherein a second end of the first and second conductors are electrically connected to the first end of the heat sensitive strip.

22. The circuit breaker of claim 21 further comprising:

an input tab electrically connected to a second end of the heater element for conducting current to the heater.

23. The circuit breaker of claim 21 further comprising:

an output tab; and a flexible conductor electrically connected between the second end of the heat sensitive strip and the output tab.

24. The circuit breaker of claim 21, wherein the first and second conductors are bent outwardly from the heater element to space the heat sensitive strip a predetermined distance from the heater element.

25. The circuit breaker of claim 19, wherein a first end of the first conductor is electrically connected to a first end of the heater element and a first end of the second conductor is electrically connected to a second end of the heater element.

26. The circuit breaker of claim 25, wherein a second end of the first conductor is electrically connected to the first end of the heat sensitive strip.

27. The circuit breaker of claim 26, wherein the first conductor is bent outwardly from the heater element to space the heat sensitive strip a predetermined distance from the heater element.

28. The circuit breaker of claim 25 further comprising:

an output tab electrically connected to a second end of the second conductor.

29. The circuit breaker of claim 19 further comprising:

an input tab including an extension extending a predetermined distance; and a flexible conductor electrically connected between the extension of the input tab and a second end of the heat sensitive strip.

30. The circuit breaker of claim 19 wherein the heat sensitive strip is a bimetallic strip.

* * * * *